United States Patent [19]

Schneider et al.

[11] Patent Number: 4,828,526

[45] Date of Patent: May 9, 1989

[54] ANIMATED TOY FIGURINE

[75] Inventors: Thomas P. Schneider, Westlake; Randy J. Randleman, Cleveland, both of Ohio

[73] Assignee: Those Characters From Cleveland, Cleveland, Ohio

[21] Appl. No.: 74,046

[22] Filed: Jul. 16, 1987

[51] Int. Cl.[4] ..... A63H 3/06; A63H 13/00; A63H 33/40; A63H 3/36

[52] U.S. Cl. ..... 446/183; 446/199; 446/217; 446/99; 446/337

[58] Field of Search ..... 446/183, 184, 185, 176, 446/180, 188, 197, 199, 200, 201, 217, 218, 243, 244, 245, 232, 97, 99, 100, 330, 337, 339, 341, 352, 353, 369, 372, 399, 395, 190, 192, 193, 195, 196

[56] References Cited

U.S. PATENT DOCUMENTS

| | | | |
|---|---|---|---|
| 2,854,788 | 10/1958 | Baggott | 446/183 |
| 3,205,610 | 9/1965 | Palumbo et al. | 446/193 |
| 3,451,160 | 6/1969 | Ryan et al. | 446/183 |
| 4,217,725 | 8/1980 | Sapkus et al. | 446/183 |
| 4,280,297 | 7/1981 | Katzman et al. | 446/183 |

FOREIGN PATENT DOCUMENTS

| | | | |
|---|---|---|---|
| 2182257 | 5/1987 | United Kingdom | 446/392 |

*Primary Examiner*—Robert A. Hafer
*Assistant Examiner*—D. Neal Muir
*Attorney, Agent, or Firm*—Calfee, Halter & Griswold

[57] ABSTRACT

A toy figurine and a fluid actuated animated module for ready detachment and attachment to the toy figurine. The toy figurine includes a means for generating and transmitting pressurized fluid which is utilized to activate an animated feature contained within the module. The figurine also includes a socket assembly to facilitate the detachment and attachment of the module and provide a fluid seal between the figurine and the module. The socket assembly includes a movable member having a front end surface which is substantially flush with the outer covering of the figurine when the module is detached. The movable member is capable of assuming a depressed position so as to permit the attachment of the module to the socket assembly and facilitate the flow of pressurized fluid from the figurine to the module.

26 Claims, 3 Drawing Sheets

ANIMATED TOY FIGURINE

DISCLOSURE

This invention relates to a toy figurine having a fluid actuated animation feature. More particularly, this invention relates to a toy figurine having a fluid actuated animated module which may be readily and easily detached and attached to the figurine.

BACKGROUND

The prior art provides various toy figurines having animated features which serve as eyes, ears, mouths or the like for the figurines. For example, Dvorak U.S. Pat. No. 2,496,152 provides a figurine with detachable mechanically animated eyes. The prior art further provides figurines having fluid actuated animated features. Specifically, Ryan et al U.S. Pat. No. 3,451,160 provides a figurine with fluid actuated animated eyes.

SUMMARY OF INVENTION

The present invention provides a new and useful toy figurine having means for providing and transmitting a pressurized fluid and a fluid actuated animation module which can be easily and readily detached and attached to the figurine.

The figurine includes a socket assembly which serves multiple purposes. More particularly, the socket assembly serves as a mounting base for releasably engaging the module and it also serves as a conduit for transmitting pressurized fluid from the figurine to the module. Additionally, the socket assembly serves to preserve the appearance of the toy figurine when the module is detached. Specifically, the socket assembly includes a movable or axially reciprocating plunger which has a front end surface which is substantially flush with respect to the outer covering of the figurine when the module is detached. Thus, in the absence of a module the figurine does not exhibit an aesthetically unattractive gap, hole, or depression. Upon attachment of the module, the plunger is easily depressed within the housing of the socket assembly so as to facilitate attachment and permit the flow of pressurized fluid from the figurine to a module.

Modules displaying various types of animation features and having various configurations may be attached to the figurine. The ability to attach any one of a variety of modules to the figurine adds an additional aspect of versatility to the figurine.

In the preferred embodiment, the module has a rotating dome which serves as the animated feature. Pressurized fluid or air flows from a collapsible fluid impermeable rubber bladder contained within the figurine, through the socket assembly, and into the module. Inside the module, the fluid is directed by a nozzle towards a propeller blade attached to the rotating dome. The propeller blade includes a plurality of curved ridges to facilitate the transfer of energy from the pressurized fluid to the propeller blade. After passing over the ridges of the propeller blade the pressurized fluid is exhausted through a plurality of exhaust ports located in the base of the module.

When the bladder is released by the user it assumes its original or uncollapsed form and the fluid follows a reversed path of flow and refills the bladder. During this reversed flow, the fluid has a minimal effect upon the rotating dome. Once the bladder is refilled, the bladder can be squeezed again to provide a new flow of pressurized fluid to the module.

The foregoing and other features of the invention are hereinafter more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
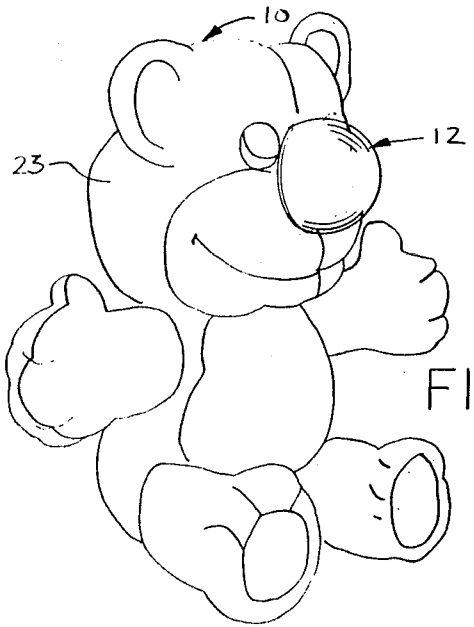
FIG. 1 is a perspective view of a toy figurine and an animated module made in accordance with the present invention.
Figure 6:
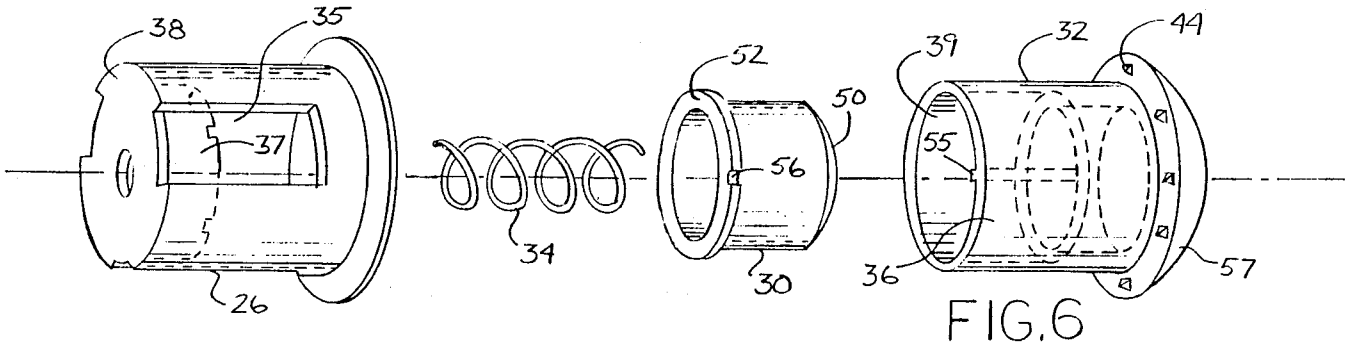
FIG. 6 is an exploded view of the receptacle assembly of FIG. 3.

Referring to the drawings, and initially to FIG. 1, there is illustrated a toy figurine 10 and a replaceable or detachable animated module 12 made in accordance with the present invention. The animated module 12 includes an animated feature which is actuated by a pressurized fluid such as air. Actuation of the module 12 produces an eye catching or visually appealing effect.

In this preferred embodiment, the module 12 serves as the nose for the figurine 10. However, it will be appreciated that module 12 may serve as any one of a variety of features for the figurine 10 including eyes, ears, a mouth and the like. Additionally, the present invention is in no way limited for use with figurines having the illustrated teddy bear appearance. A figurine made in accordance with the present invention may manifest any one of a variety of appearances including artifacts, toys, models or the like.

Figure 2:
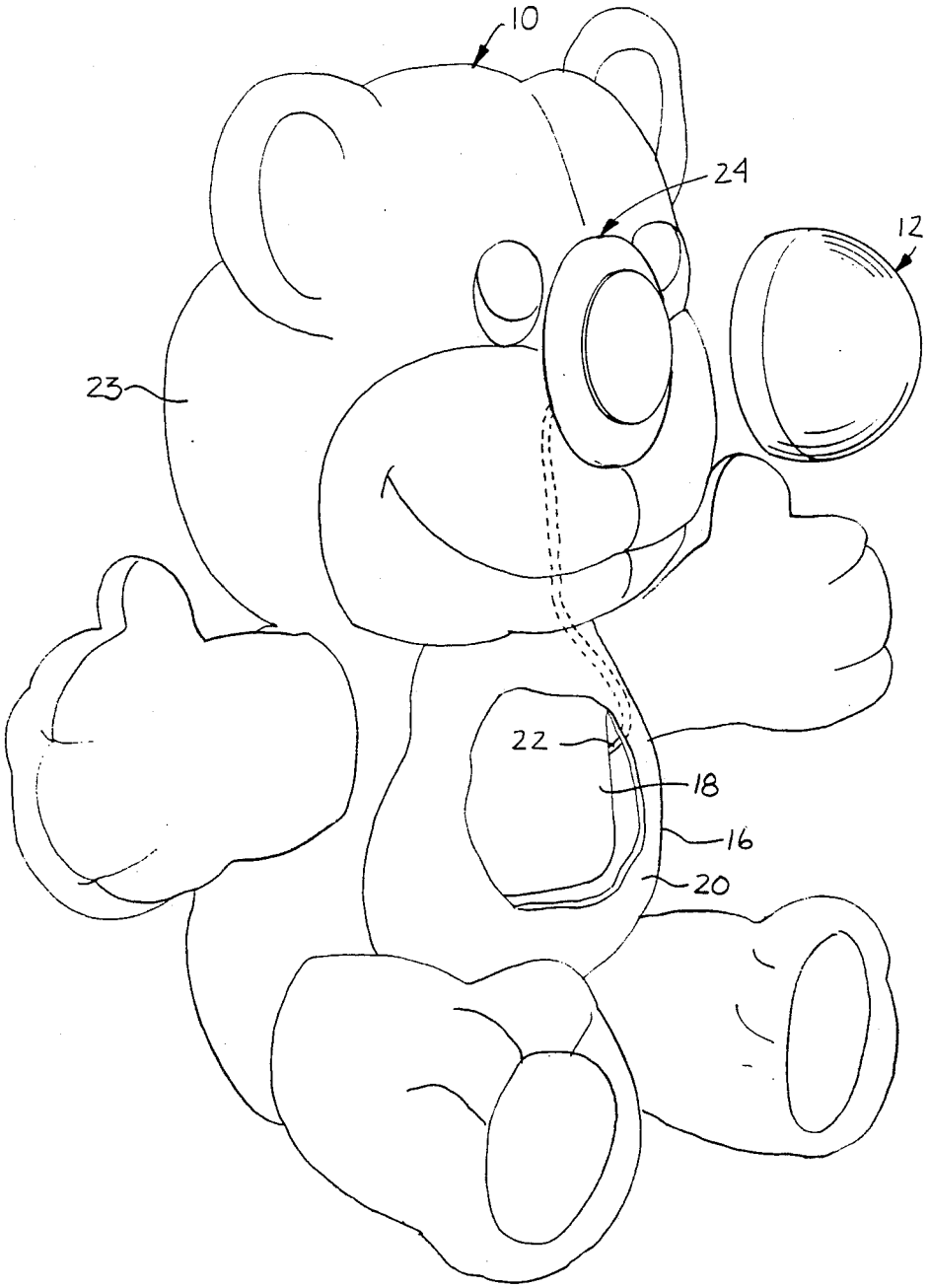
FIG. 2 is a partially broken away perspective view of the toy figurine of FIG. 1 with the animated module removed.
Figure 3:
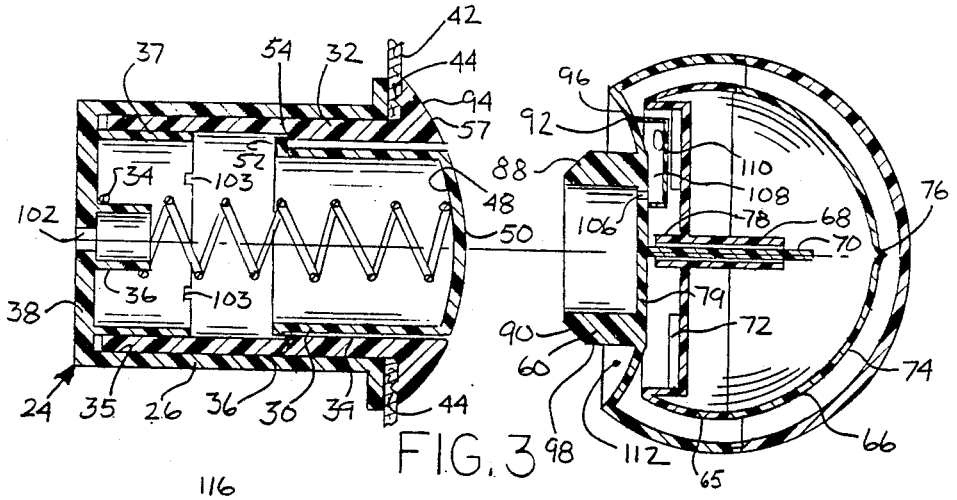
FIG. 3 is a cross-sectional plan view of the socket assembly and module illustrated in FIG. 2.

Illustrated in FIG. 2 is the means for producing and transmitting the pressurized fluid to the module 12. More particularly, the figurine 10 includes a trunk portion 16 having a compressible bellows or bladder 18 located therein. Surrounding the bladder 18 is a pliant or flaccid outer covering material 20 such as vinyl or a fabric comprising fibers of cotton, wool, polyester, or other like commercial fiber. The fabric may include any one or a combination of surface finishes including cut, plush or pile, so as to provide the figurine 10 with the desired appearance.

The bladder 18 is preferably constructed of a suitable flexible and fluid impermeable material such as rubber or plastic. When the trunk 16 is squeezed or compressed by a user, the bladder 18 is in turn compressed and the fluid contained therein is pressurized. Connected to the bladder 18 is a length of tubing 22 which provides a fluid communication between the bladder 18 and the module 12.

Referring now to FIGS. 3–6, the module 12 and the means for facilitating detachment and attachment of the module 12 to the figurine 10 are clearly shown. More particularly, provided in the head 23 of the figurine 10 is a receptacle or socket assembly 24 which serves as a mounting base for the module 12. Socket assembly 24 comprises a cylindrical housing 26 which is located within the head 23 of the figurine 10. Included within the housing 26 is a movable member or cylindrical plunger 30, a plunger retainer 32 and a spring 34. The inside diameter walls 35 of the housing 26 are only slightly larger than the outside diameter walls 36 of the retainer 32 so that when the retainer 32 is inserted within the housing 26 a snug engagement develops. This engagement is further enhanced by upstanding wall 37 which protrudes from the bottom 38 of the housing 26 and engages the inner diameter wall 39 of the retainer 32.

The socket assembly 24 is secured within the head 23 of the figurine 10 by wedging a portion of the fabric 42, which forms the outer covering of the head 23, between the retainer 32 and the housing 26. The friction fit between the retainer 32, housing 26 and fabric 42 firmly secures the socket assembly 24 within the head 23. Preferably, the retainer 32 includes a plurality of protruding legs or detents 44 which further enhance the bite or friction fit between the retainer 32, housing 26 and fabric 42.

Spring 34 is positioned at one end within the socket assembly 24 by a cylindrical wall 36 protruding from the bottom 38 of the housing 26. The other end of the spring 34 abuts the inner wall 48 of the front end surface 50 of the plunger 30. The spring 34 biases the plunger 30 to a forward position wherein the protruding rim 52 at the base of the plunger 30 engages a ridge 54 formed along the inner diameter wall 39 of the retainer 32 preventing further forward travel of the plunger 30. The axially reciprocating travel of plunger 30 is further guided by rectangular rail 55 formed along the inner diameter wall 39 of the retainer 32. Rail 55 is adapted to be loosely received within and extend through notch 56 formed in rim 52 of the plunger 30. In the forward biased position the front end surface 50 is substantially flush with the outer covering of fabric 42 and the rounded rim 57 of the retainer 32.

Module 12 includes a base 60 having attached thereto a clear or light transmitting cover 62 which permits a user to view the display features contained therein. Base 60 and cover 62 include mating tongue and groove edges 63 and 64 respectively which facilitate the attachment of the cover 62 to the base 60. Additionally, cover 62 may also be attached to base 60, for example, by a suitable adhesive, sonic or thermal welding, or the like. Contained within the confines of cover 62 is the animated feature which comprises a propeller blade 65 and a rotating dome 66. The propeller blade 65 includes a bearing 68 which rotates upon axle 70 protruding from base 60.

Propeller blade 65 also includes a plurality of protruding ridges 72 which are adapted to capture and engage the flow of pressurized fluid. Preferably, as illustrated, ridges 72 are slightly curved in the direction of rotation to enhance the transfer of energy from the pressurized fluid.

Rotating dome 66 includes on the outer surface 74 a protrusion 76. Upon rotation of the dome 66, protrusion 76 abuts the cover 62 providing a bearing surface which limits the forward thrust of the rotating dome 66 and propeller blade 65. Rearward thrust of the rotating dome 66 and propeller blade 64 is limited by the end portion 78 of bearing 68 abutting the bottom 79 of base 60.

Figure 8:
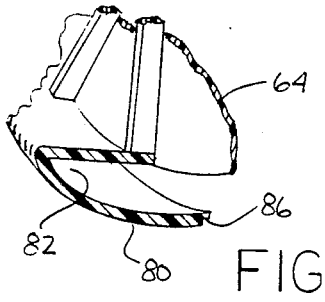
FIG. 8 is a perspective fragmentary and partially cross-sectioned view of the propeller blade of FIG. 4.

As illustrated in FIG. 8, the outer edge of the propeller blade 65 includes a folded lip 80 which forms a groove 82. The outer edge of the folded lip 80 includes a tongue and groove 86 which mates with a tongue and groove 87 formed along the outer edge of the rotating dome 66. In addition to the tongue and grooves 86 and 87, the rotating dome 66 may be attached to the base 60 utilizing, for example, a suitable adhesive, sonic or thermal welding, or the like.

Figure 7:
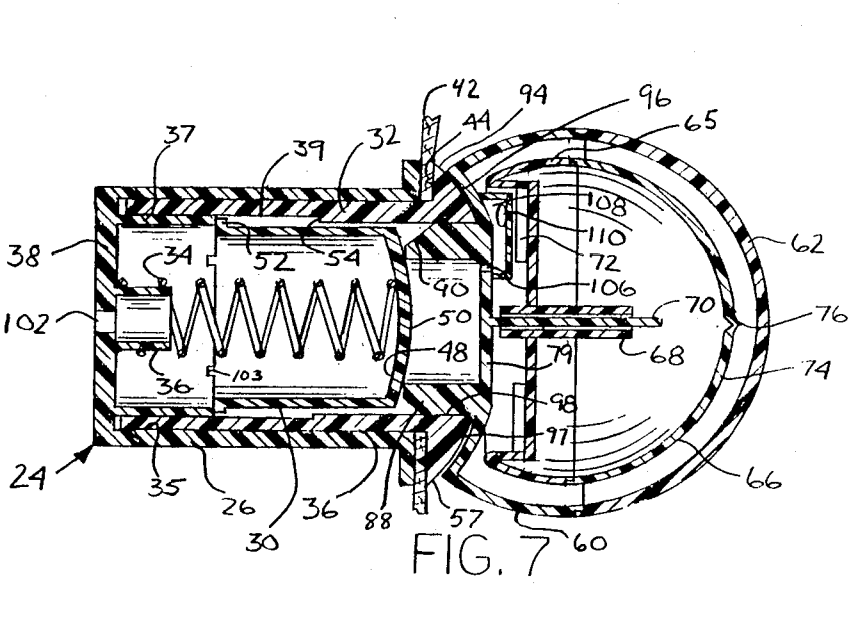
FIG. 7 is a cross-sectional view of the receptacle assembly and module of FIG. 3 with the module inserted and engaging the receptacle assembly.

The base 60 is constructed so as to facilitate easy and ready detachment and attachment of module 12 to the socket assembly 24. Specifically, base 60 includes a rim 88 which is adapted to be received within the retainer 32. The outer diameter of the rim 88 includes a taper 90 to facilitate insertion of the base 60 within retainer 32. Base 60 further includes a recessed portion 92 which is adapted to receive the rounded leading end 94 of the retainer 32. As illustrated in FIG. 7, upon insertion of the rim 88 within the retainer 32, the end of the rim 88 contacts the end face 50 of the plunger 30 and depresses or pushes the plunger 30 against the biasing force of the spring 34 further into the confines of retainer 32. The rim 88 of the base 60 seats itself within the retainer 32 just before the leading end 94 of the retainer 32 contacts the outer surface 96 of the recessed portion 92 leaving a gap 97 therebetween. Simultaneously therewith, the outer surface 98 of the rim 88 contacts and frictionally engages the inner diameter wall 39 of the retainer 32 providing a fluid seal therebetween. This type of connection between the base 60 and the retainer 32 requires no registration. Thus, a user may mount the module 12 throughout the full 360 degrees of the retainer 32. It will be appreciated that additional means may be provided to ensure an even more secure engagement between the base 60 and the retainer 32. For example, the outer surface 98 of the rim 88 could include a detent which would engage a keyed slot provided within the inner wall 39 of the retainer 32. However, this type of connection would require registration between the module 12 and the socket assembly 24.

With the module 12 attached to the socket assembly 24, fluid flows into the base 60 of housing 26 through opening 102, through notches 103 provided in the upstanding wall 37 and around rim 52, between the plunger 30 and the inner diameter wall 39 of the retainer 32, through a pair of diametrically opposed recesses 104 provided in rim 88, into the confines of rim 88, through opening 106 and into chamber 108 formed in base 60. From the chamber 108 the fluid flows through nozzle 110 which directs the flow of the fluid at the ridges 72 of the propeller blade 65. The ridges 72 capture energy from or are acted upon by the flowing pressurized fluid causing the rotational dome 66 to rotate. Preferably, the outer surface 74 of the rotating dome 66 includes a graphical design which enhances the appearance of the dome 66 upon rotation thereof.

After the fluid passes over the ridges 72 it then flows through exhaust ports 112 provided in base 60 and out gap 97 which opens to the atmosphere. Preferably, the exhaust ports 112 are not located in the immediate proximity of the nozzle 110. Additionally, to ensure adequate exhaust through gap 97, the diameter of the leading end 84 of the retainer 32 is preferably greater than the diameter of the recessed portion 92 of the base 60 by a distance at least twice that of any matte or fibers which may protrude from the outer covering fabric 42 of the head 23. This increased diameter serves to prevent such matte or fibers from getting trapped between the recessed portion 92 of the base 24 and the leading end 94 of the retainer 32 and restricting the flow of fluid through the exhaust ports 112 and gap 97.

The location of the exhaust ports 112 and nozzle 110 are such that when a user releases the bladder 18, the flow of fluid is reversed. This reversed fluid flow refills the bladder 18 in such a manner as to minimally effect the rotation of the rotating dome 66.

Figure 5:
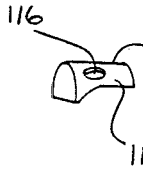
FIG. 5 is an enlarged perspective view of the nozzle of FIG. 4.
Figure 4:
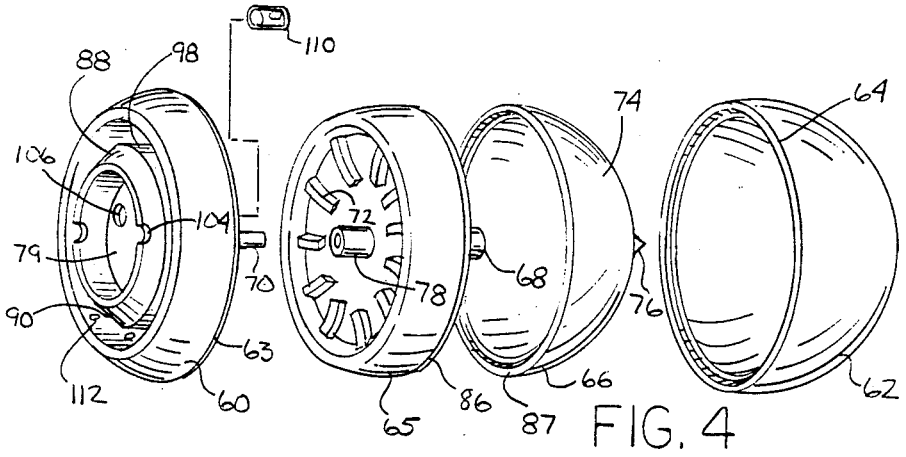
FIG. 4 is an exploded view of the module of FIG. 3.

As illustrated in FIG. 5, nozzle 110 is of a conventional configuration and it includes a stem 114 and an opening 116 which serves to direct the flow of pressurized fluid towards the ridges 72 of the propeller blade 64. Preferably, as shown, the nozzle 110 is located as close as possible to the outer diameter of the propeller blade 65 so as to effectively maximize the transfer of energy from the pressurized fluid to the ridges 72 of the propeller blade 65.

Removal of the module 12 from the socket assembly 24 is achieved by pulling the module 24 away from the head 23 of the figurine 10 and breaking the seal formed between the outer surface 98 of the rim 88 and the inner diameter wall 39 of the retainer 32. Upon removal of the module 12, the plunger 30 returns to its forward biased position wherein the end face 50 is substantially flush with the outer covering of fabric 42 of the head 23 and the rounded rim 57 of the retainer 32. This forward bias of the plunger 30 eliminates the formation of a depression or gap upon the head 23 of the figurine 10 and creates an aesthetically pleasing appearance in the absence of the module 12. While the axially reciprocating plunger 30 is preferred, it will be appreciated that various other means may be provided for eliminating the formation of a depression or gap when the module 12 is removed. For example, a hinged door may be provided which pivots out of the way and open to allow attachment of the module 12 and pivots closed when the module 12 is removed.

Although only one type or form of air actuated module 12 with a specific type of animated feature has been illustrated, it will be appreciated that modules having various other types of animated features are contemplated by the present invention. For example, other modules may display a random motion such as that caused by the pressurized air flow being directed towards loose confetti or one or more balls which are part of a game and contained within the confines of the cover of the module. Additionally, it will be appreciated that modules having various configurations other than the illustrated dome shape configuration are contemplated by the present invention. For example, such modules may be cylindrical, hexagonal, or cone shaped.

Furthermore, it will be appreciated that with the ability of the figurine to employ various types of modules, various different visual effects can be created with the figurine 10 depending upon which particular module is utilized. This ability to utilize different modules with the figurine 10 results in an added degree of versatility and appeal for the toy.

Additionally, it will be appreciated that in addition to the illustrated bladder 18 for producing pressurized fluid, any one of a variety of other sources of pressurized fluid may be utilized such as, for example, a battery powered compressor or a pressurized container of fluid.

Although any one of a variety of materials may be utilized to produce the socket assembly and the module, preferably plastic or a similar material is utilized to produce most of the elements. Specifically, preferably a high impact polystyrene is utilized to produce essentially all of the elements except the spring 34, the retainer 32, and the base 60. A suitable material for use in producing the spring 34 is spring steel. The retainer 32 and base 60 are preferably constructed of an acetal resin sold under the trademark "DELRIN 500" by E.I. DuPont de Nemours Company, or the trademark "CELCON M90" by the Celanese Corporation. Acetal resins exhibit superior wear resistance and will thus help to ensure a tight fluid seal between the retainer 32 and the base 60 during repeated attachment and detachment of the module 12 to the socket assembly 24.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A toy figurine having a body, fluid means connected with said body for producing and transmitting a pressurized fluid, a fluid sactuated module having an animatable feature responsive to flow of said fluid, said module comprising a detachable unit which may be attached and detached with respect to said body and which upon attachment to said body establishes a fluid connection between said body and said module facilitating the transmission of said fluid between said fluid means and said module, and socket means to facilitate the attachment and detachment of said module, said socket means including a movable member forming a front end surface which is substantially flush with respect to the outer covering of said body and which forms a substantially continuous surface with respect to the outer covering of said body when said module is not attached to said socket means.

2. A toy figurine as set forth in claim 1 wherein said movable member comprises an axially reciprocating plunger.

3. A toy figurine as set forth in claim 2 wherein said socket means further includes a spring which biases said plunger towards a forward position which is substantially flush with respect to the outer covering of said body when said module is not attached to said socket means.

4. A toy figurine as set forth in claim 2 wherein said fluid means comprises a collapsible bladder and a tube for directing the flow of air between said bladder and said socket means.

5. A toy figurine as set forth in claim 4 wherein said plunger assumes a depressed position within said socket means upon attachment of said module to said socket means.

6. A toy figurine as set forth in claim 4 wherein said module includes a rotational propeller blade which is acted upon by such pressurized fluid flowing to said module.

7. A toy figurine as set forth in claim 6 wherein said module further includes a stationary nozzle to direct the flow of such pressurized fluid towards said propeller blade.

8. A toy figurine as set forth in claim 7 wherein said propeller blade includes a plurality of raised ridges to enhance the transfer of energy from such pressurized fluid to said propeller.

9. A toy figurine as set forth in claim 8 wherein said raised ridges of said propeller blade are curved in the direction of rotation of said propeller blade.

10. A toy figurine as set forth in claim 9 wherein said module includes a plurality of exhaust ports which open to the atmosphere and allow such pressurized fluid to exit said module after such pressurized fluid has passed over said ridges of said propeller blade.

11. A toy figurine for use with a fluid actuated animated module; said figurine having a body with an outer covering, fluid means for producing and directing the flow of a pressurized fluid, and a socket means adapted to receive and secure such module and facilitate the transmission of said fluid to such module; said socket means having a movable member forming a front end surface which is substantially flush with respect to the outer covering of said body and which forms a substantially continuous surface with respect to the outer covering of said body when such module is not attached to said socket means.

12. A toy figurine as set forth in claim 11 wherein said movable member comprises a plunger.

13. A toy figurine as set forth in claim 12 wherein said socket means further includes spring means which bias said plunger in a forward position wherein said front end surface is substantially flush with respect to the outer covering of said body when such module is not attached to said socket means.

14. A toy figurine as set forth in claim 13 wherein said plunger assumes a depressed position within said socket means upon attachment of such module to said socket means.

15. A toy figurine as set forth in claim 14 wherein said plunger includes a rim and such pressurized fluid flows around said rim and to such module when such module is attached to said socket means.

16. A toy figurine as set forth in claim 14 wherein said fluid means comprises a collapsible bladder having connected thereto a tube which directs the flow of such pressurized fluid from said bladder to said socket means.

17. A toy figurine as set forth in claim 16 wherein said socket means includes a bottom surface, said bottom surface having an opening which permits the flow of such pressurized fluid from said tube and into said socket means.

18. A toy figurine as set forth in claim 14 wherein the outer covering of said body comprises a pliant material.

19. A toy figurine as set forth in claim 18 wherein said pliant material comprises fabric.

20. A toy figurine as set forth in claim 19 wherein said pliant material comprises vinyl.

21. A toy figurine as set forth in claim 14 wherein said body includes a head and said socket means is mounted within said head and forms a nose for said toy figurine.

22. A toy figurine as set forth is claim 11 wherein aid body includes an outer covering material and said socket means includes a housing and a retainer, said housing receiving and engaging said retainer.

23. A toy figurine as set forth in claim 22 wherein a portion of said outer covering material is captured between said housing and retainer securing said socket means to said figurine.

24. A toy figurine as set forth in claim 23 wherein said housing is located within the inner confines of said outer covering material and at least a portion of said retainer is located outside the inner confines of said outer covering material.

25. A toy figurine as set forth in claim 24 wherein said portion of said retainer located outside the inner confines of said outer covering material comprises a rounded rim of said retainer and said front end surface of said movable member is substantially flush with respect to said rounded rim when such module is not attached to said socket means.

26. A toy figurine as set forth in claim 22 wherein said movable member is contained within said retainer and the inside of said retainer is configured to provide a fluid conduit around said movable member when such module is attached to said socket means.

* * * * *

UNITED STATES PATENT AND TRADEMARK OFFICE

CERTIFICATE OF CORRECTION

PATENT NO. : 4,828,526

DATED : May 9, 1989

INVENTOR(S) : Schneider, et al.

It is certified that error appears in the above-identified patent and that said Letters Patent is hereby corrected as shown below:

Column 6, line 28, please replace "sactuated" with --actuated--.

Column 8, line 17, please replace "aid" with --said--.

Signed and Sealed this

Twenty-fourth Day of October, 1989

*Attest:*

DONALD J. QUIGG

*Attesting Officer*

*Commissioner of Patents and Trademarks*